United States Patent [19]

Jasper, Jr.

[11] Patent Number: 4,831,913

[45] Date of Patent: May 23, 1989

[54] PROJECTILE WITH A DETACHABLE HEADER FOR ELECTROMAGNETIC LAUNCHER

[75] Inventor: Louis J. Jasper, Jr., Ocean, N.J.

[73] Assignee: The United States of America as represented by the Secretary of the Army, Washington, D.C.

[21] Appl. No.: 61,627

[22] Filed: Jun. 15, 1987

[51] Int. Cl.[4] ..... F41F 1/02

[52] U.S. Cl. ..... 89/8; 89/14.6; 102/517; 102/520

[58] Field of Search ..... 89/8, 14.6; 102/517, 102/518, 519, 520, 521, 522, 523, 524, 525, 526, 527, 528

[56] References Cited

U.S. PATENT DOCUMENTS

| | | | |
|---|---|---|---|
| 422,347 | 2/1890 | Hyde | 89/14.6 |
| 577,183 | 2/1897 | Borchardt | 102/517 |
| 1,204,282 | 11/1916 | Lake | 102/518 |
| 3,431,816 | 3/1969 | Dale | 89/8 |
| 4,369,692 | 1/1983 | Kemeny | 89/8 |
| 4,424,748 | 1/1984 | Schiff | 102/523 |
| 4,704,943 | 11/1987 | Mc Dougal | 89/36.02 |

FOREIGN PATENT DOCUMENTS

| | | | |
|---|---|---|---|
| 46057 | 4/1916 | Sweden | 102/520 |

*Primary Examiner*—Stephen C. Bentley

*Attorney, Agent, or Firm*—Sheldon Kanars; James J. Drew

[57] ABSTRACT

A projectile suitable for use with an electromagnetic launcher or railgun. The projectile has a detachable conductive header portion which mates closely with and is restrained by one of the rails of a railgun. The header eliminates arcing and rail damage. The remainder of the projectile is ejected through a hole in the header toward a target.

9 Claims, 5 Drawing Sheets

PROJECTILE WITH A DETACHABLE HEADER FOR ELECTROMAGNETIC LAUNCHER

The invention described herein may be manufactured, used, and licensed by or for the Government for governmental purposes without the payment to me of any royalty thereon.

TECHNICAL FIELD

This invention relates generally to projectiles and particularly to projectiles suitable for launching by electromagnetic railguns.

BACKGROUND OF THE INVENTION

Conventional guns and projectile launching weapon systems utilize the burning of chemical propellants to achieve high projectile velocity. In recent years there has been a renewed interest in projectile launchers which utilize electromagnetic energy. Generally speaking, electromagnetic launchers promise higher projectile velocities than launchers utilizing chemical propellants. Typical electromagnetic launchers utilize electromagnetic forces on conductive projectiles to accelerate the projectiles at high velocities toward a chosen target. A typical projectile frequently used with an electromagnetic launcher, unlike a conventional artillery round or small-arms bullet, does not require a primer and propellant or explosive. The absence of primers and chemical propellants makes electromagnetic projectiles safer to transport and store.

Applicant's co-pending application, titled "Electromagnetic Injector/Railgun," Ser. No. 910,915, Filed Sept. 22, 1986, now abandoned, discloses a novel railgun device in which a projectile is launched in a direction perpendicular to two parallel conducting rails. The projectile is launched by the repulsive force created by oppositely-flowing currents through the two rails. One of the rails is completely severed by a gap, dimensioned to receive the projectile. If the projectile is not within the gap, current cannot flow through the rails. However, when the projectile is injected into the gap (by mechanical or pneumatic means) the projectile spans the gap, and current flows through the rails and through the projectile, generating the aforementioned repulsive force and ejecting the projectile from the gap towards a target.

To generate a large repulsive force (and thus achieve high projectile velocities) it is necessary that high currents must flow through the rails and the projectile. Experiments have shown that slight mismatches at the interface between the projectile and the sides of the gap cause arcing and rail damage. Damage to the rail makes the firing of subsequent shots difficult, if not impossible and requires time-consuming maintenance.

Those concerned with railgun development have consistently sought new devices for eliminating arcing and rail damage.

SUMMARY OF THE INVENTION

The present invention features a projectile with a detachable wedge-shaped header section positioned at the front end. The header section has two metallic halves separated by insulators. When the projectile is injected toward the rail gap, the metallic portion of the wedge-shaped header contacts the rails first, forming a low-resistance (and arcless) contact with the rail. The rest of the projectile (which resembles a bullet) passes through a hole in the center of the wedge-shaped header. A sliding electrical contact is made between the moving bullet portion of the projectile and the interior of the metallic header. If arcing occurs, it will occur principally at the aforementioned sliding interface. After the bullet passes completely through the header towards the target, the header drops away from the rails and the gun is ready for a new shot. The rail itself is thus free from any damage caused by arcing and therefore capable of sustaining many shots without damage. The spent header section may be discarded.

Accordingly, it is an object of the present invention to provide a projectile which does not utilize a chemical propellant or primer.

It is another object of the present invention to provide a simple, compact projectile suitable for use with an electromagnetic projectile launcher.

A further object of the present invention is to provide a projectile suitable for use with an electromagnetic projectile launcher which will minimize launcher arcing and rail erosion damage.

A still further object of the present invention is to provide a projectile with a detachable header section.

Yet another object of the present invention is to provide a projectile which will increase railgun (launcher) operating life.

BRIEF DESCRIPTION OF THE DRAWINGS

Further objects and advantages of the present invention will become apparent to those familiar with the art upon examination of the following detailed description and accompanying drawings in which.

DETAILED DESCRIPTION OF THE PREFERRED EMBODIMENTS

Figure 1:
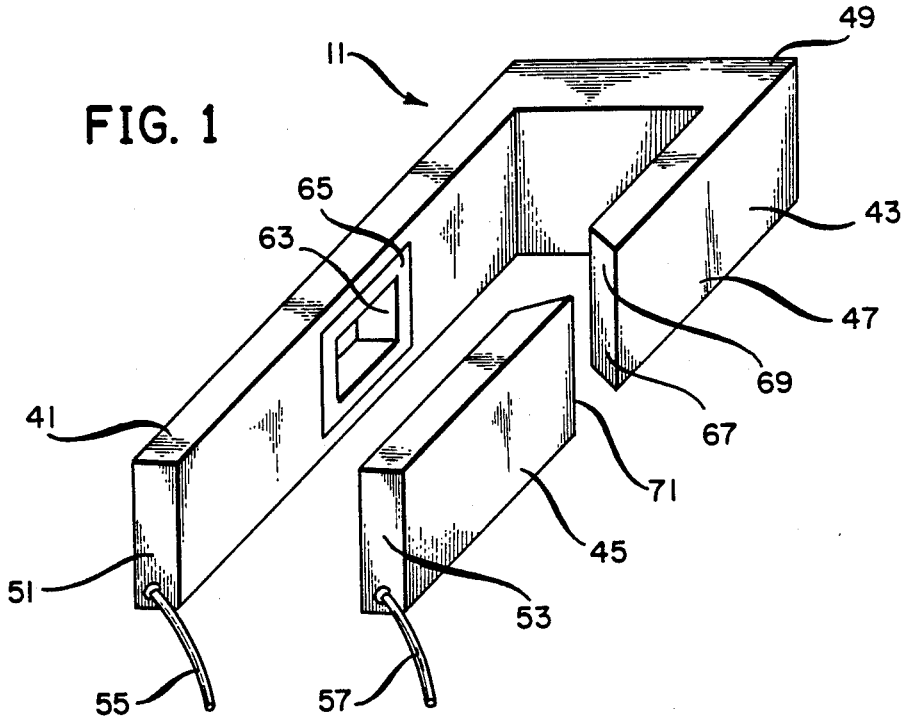
FIG. 1 is a schematic perspective view of a typical railgun suitable for use with the present invention.

Referring to the drawings, and particularly to FIG. 1, wherein like reference numerals refer to like components throughout, reference numeral 11 designates generally a railgun similar to that disclosed in the aforementioned co-pending, now abandoned, application. Since the inventive device featured in FIG. 2 is launched from the railgun depicted in FIG. 1, a few words will be devoted to explaining the operation of the railgun launcher of FIG. 1 first.

The device shown in FIG. 1 features two long, electrically conductive rails 41 and 43. The rails are joined by a comparatively short conductive section 49. The length of rails 41 and 43 is considerably longer than the length of section 49. Section 49 need not physically resemble rails 41 and 43 at all. The only purpose of section 49 is to conduct current from rail 41 to rail 43 (or vice versa) and so, section 49 may be conductive wire or cable. The entire assembly, consisting of rail 41 and 43 and section 49 is immovably anchored on a platform 400 (shown in FIGS. 10 and 11, but omitted from FIG. 1 for clarity). Rail 43 is split into two sections, 45 and 47. A gap 67 separates sections 45 and 47. A dc voltage source (not shown) is connected via leads 55 and 57 to ends 51 and 53 respectively, of rails 41 and 45. The presence of gap 67 prevents current from flowing through rails 41, 49 and 43. However, should the gap be closed by the presence of conducting material, current will flow through rails 41, 49 and 43. The oppositely-directed currents flowing through rails 41 and 43 will create a strong repulsive force which will forcibly eject a metallic projectile should it be present within gap 67. A hole 63 surrounded on all sides by insulation 65 is positioned within rail 41 opposite gap 67. Presence of the hole 63 permits introduction of a projectile from the left of the diagram by mechanical or pneumatic means into gap 67. Insulator 65 which surrounds hole 63 prevents conductive contact between the projectile and rail 41. It should be noted that hole 63 does not sever or break electrical continuity in rail 41. As will be explained later, the size of hole 63 must be larger than the projectile illustrated in FIG. 2.

It should be noted that gap 67 is somewhat V-shaped having an opening which is larger near rail 41. The significance of the V-shaped gap 67 will become apparent from an examination of FIGS. 2, 3, 4, 10 and 11 which illustrate the inventive device and its cooperation with the railgun of FIG. 1.

Figure 2:
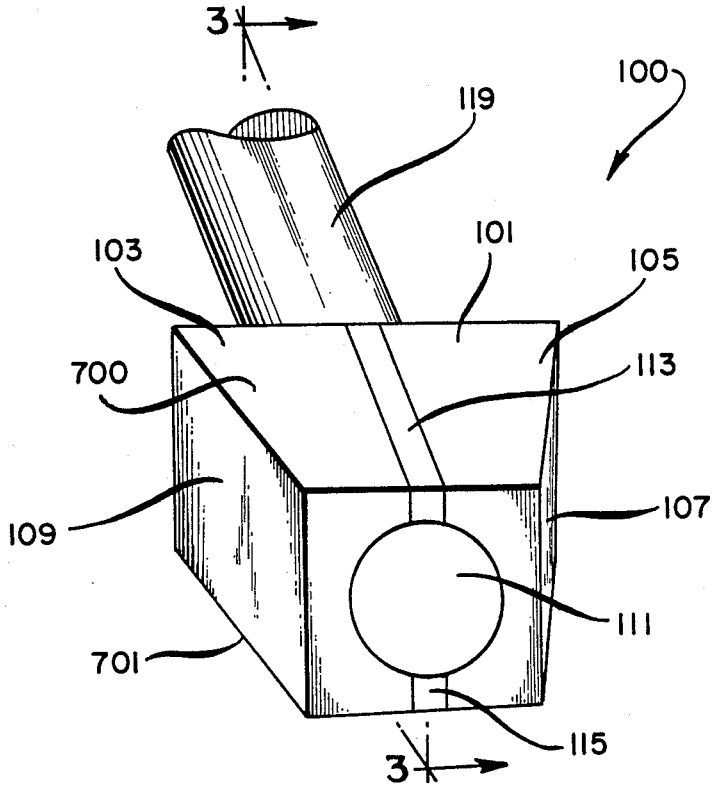
FIG. 2 is a perspective view of a preferred embodiment of the present invention.

Turning now to FIG. 2 there is shown generally, the inventive projectile 100. Header section 101 is generally wedge-shaped Header 101 is divided into two conductive portions 103 and 105. As can be appreciated from FIGS. 2, 4, 10 and 11 the wedge-shaped header 101 mates closely with gap 67 and does not pass through gap 67. Specifically, side 107 of header portion 105 fits closely against surface 69 of rail 47, while side 109 of header portion 103 fits closely against surface 71 of rail portion 45. The slopes of header surfaces 107 and 109 closely match corresponding slopes of surfaces 69 and 71 of rails 47 and 45 respectively.

A slidable cylindrical nonconducting insert 111 is positioned generally within the center of header 101. Two insulating inserts 113 and 115, shown in FIGS. 2, 3, 10 and 11 are positioned within the top and bottom of header 101. Inserts 113 and 115, together with cylindrical insert 111 serve to completely separate conductive halves 103 and 105 of header 101. That is, in the configuration described thus far, it is not possible for current to pass from header portion 105 to header portion 103 because current flow is completely blocked by inserts 113, 115 and 111, as can be fully appreciated from FIG. 3.

Figure 3:
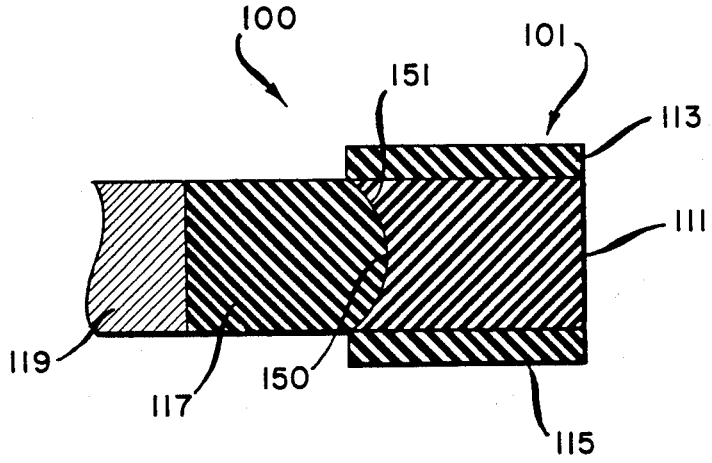
FIG. 3 is a cross-sectional view of the device of FIG. 2 cut along the line 3—3 and looking in the direction of the arrows.
Figure 4:
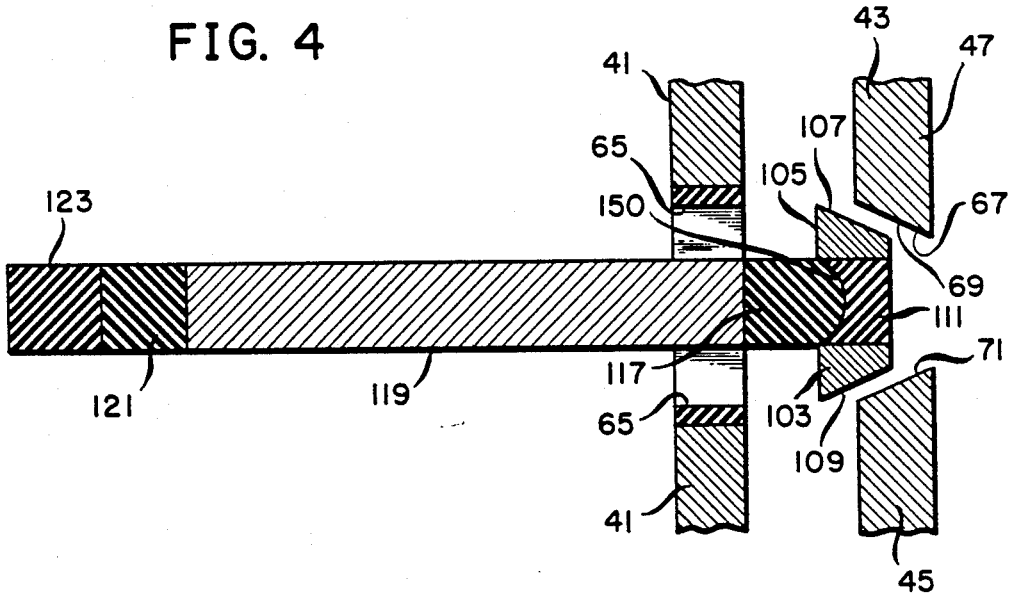
FIG. 4 is a cross-sectional view illustrating how the inventive device depicted in FIG. 2 fits within the railgun depicted in FIG. 1.

Turning now to FIGS. 3 and 4, the remainder of the projectile construction may be understood. Insert 111 is followed and contacted by insulator section 117. Insulator 117 is generally cylindrical, having the same diameter as insert 111. The front portion 150 of insert 117 is curved outward and closely mates with a corresponding recess 151 in insert 111.

Insert 117 is followed by a comparatively long conductive armature section 119. The conducting armature section 119 is followed by an arc resistant section 121 and a snubber 123.

Both the arc resistant section 121 and snubber 123 are made from arc resistant materials such as plastic impregnated with carbon and perhaps reinforced with fiberglass. The purpose of both sections is to gradually reduce the gun's signature. Insert 117, and armature 119, together with arc resistant section 121, and snubber 123 comprise a bullet which is shot toward a chosen target.

Figure 10:
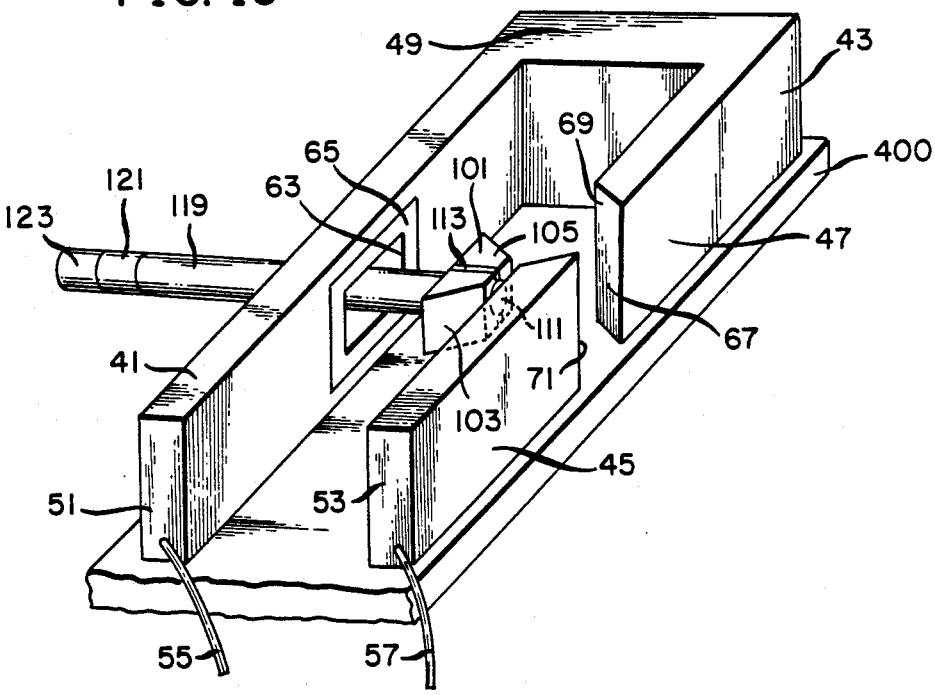
FIGS. 10 and 11 are perspective views illustrating operation of one embodiment of the inventive device.
Figure 11:
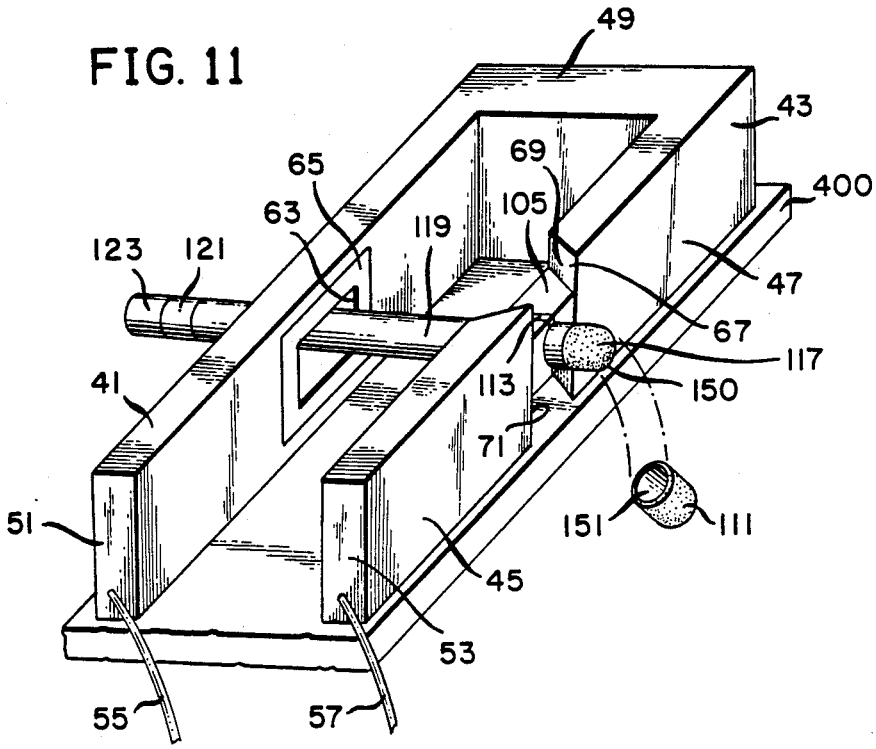

Operation of the inventive device may be appreciated from an examination of FIGS. 4, 10 and 11. The projectile 100 is injected through hole 63 of railgun 11 by mechanical or pneumatic means. Since hole 63 is larger than header 101, there is no contact between header 101 and the sides of hole 63. Insulator 65 merely serves to prevent accidental contact between the metallic portion 119 of projectile 100 and rail 41.

As projectile 100 proceeds toward the right in FIG. 4, surface 107 of header 101 contacts surface 69 of rail 47 and surface 109 of header 101 contacts surface 71 of rail 45. Header 101 becomes wedged in gap 67. However, as mentioned before, the presence of insulators 113, 115 and 111 prevents current from flowing between rail segment 47 and rail segment 45. However, momentum of projectile 100, due to the original injection impulse, causes projectile sections 177, 119, 121 and 123 (i.e., the bullet) to push slideable insert 111 to the right and out of header 101. As projectile sections 117, 119, 121 and 123 (i.e. bullet) proceed to the right, no current flows until conductive armature section 119 contacts header sections 105 and 103. As soon as conductive armature section 119 passes through header 101, a current path is formed from rail 41, through section 49, through rail segment 47, header section 105, projectile armature section 119, header section 103, and rail segment 45. The completed current path permits large, oppositely directed currents to flow through rails 41 and 43 producing a strong force which serves to greatly accelerate conductive section 119 and those section permanently attached to it (namely insulator 117, and sections 121 and 123). Thus the bullet is shot toward a target. Header sections 105 and 103, of course, are wedged between projectile 100 and gap 67 and are therefore, temporarily immovable. The magnetic force acting on armature section 119 is also acting on header sections 105 and 103, but unlike armature section 111, the header sections 105 and 103 are not free to move towards the right, but are constrained from movement by wedge-shaped gap 6..

Section 111 merely drops away after it has been pushed out of place by the rest of the projectile. Because of the good fit between surfaces 107 and 69 and surfaces 109 and 71 there is little or no arcing at these interfaces. Any arcing will take place preferentially at the sliding interface between conductive section 119 and header sections 105 and 103.

After projectile 100 has been ejected, header sections 105 and 103 will drop from their positions in gap 67 (or they may be knocked from place by mechanical means and a new projectile with a new header may be launched by repeating the above-described sequence.

The relative lengths of the various projectile sections shown in FIG. 4 are somewhat arbitrary. Insulator section 117 should be of sufficient length to allow header sections 105 and 103 to seat properly before current is initiated. Conductive armature section 119 should be comparatively long to enhance the propulsive force on the projectile. Arc resistant section 121 is a transition region from the highly conductive metallic portion 119 to the poorly conducting snubber section 123. Arc resistant section 121 may be eliminated if a lighter weight projectile is necessary. Snubber section 123 is used to reduce the current to zero and thereby prevent a signature.

A very low voltage drop across the interface between the header and the rails (i.e. between surfaces 107 and 69 and surfaces 109 and 71) is necessary in order to avoid metal fusing. Coating of the interfaces with a wetting material such as silver may be beneficial.

Figure 5:
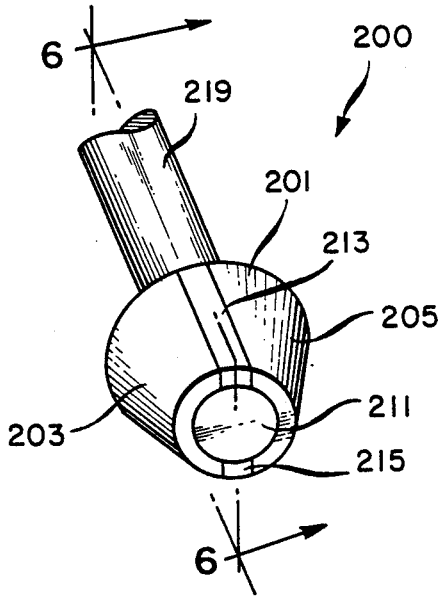
FIG. 5 is a perspective view of an alternative embodiment of the present invention.
Figure 6:
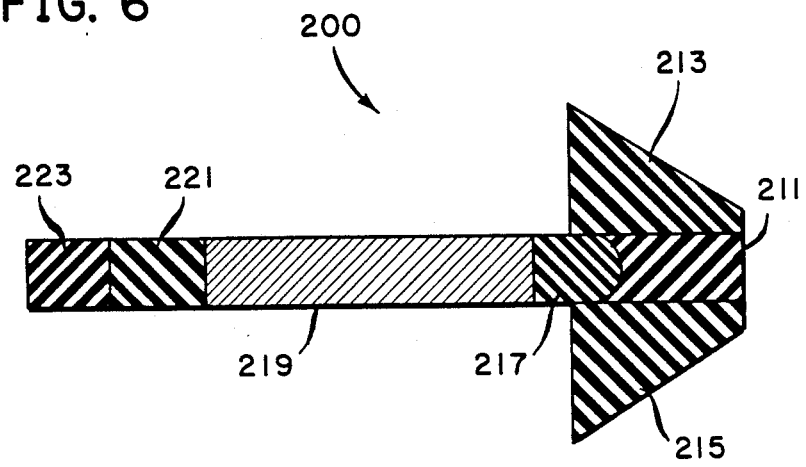
FIG. 6 is a cross-sectional view of the device of FIG. 5 cut along the line 6—6 and looking in the direction of the arrows.

Another embodiment of the present invention is depicted in FIGS. 5 and 6. The projectile depicted in FIG. 5 is similar to the projectile depicted in FIG. 2, except that the projectile of FIG. 5 has a conical shaped header instead of a wedge shaped header. Of course, for successful operation of the projectile depicted in FIG. 5, it is necessary that railgun surfaces such as those depicted by reference numerals 71 and 69 in FIG. 1 be contoured to closely receive header 201.

Header 201 of FIG. 5 is generally conical shaped. Header 201 is divided into two conductive portions 203 and 205. A slidable cylindrical non-conducting insert to 211 is positioned generally in the center of header 201. Two insulating inserts 213 and 215, shown in both FIGS. 5 and 6 are positioned within the top and the bottom of header 201. Inserts 213 and 215, together with cylindrical insert 211 serve to completely separate conductive halves 203 and 205 of header 20.. Consequently, in the configuration described thus far it is not possible for current to pass from header portion 205 to header portion 203 because current flow is completely blocked by inserts 213, 215 and 211 as can be appreciated from FIG. 6. FIG. 6 illustrates the remainder of the projectile in cross-section. Insert 211 is followed and contacted by insulator section 217. Insulator section 217 has a curved nose which protrudes into header 201. Insulator 217 has a circular cross-section and has the same diameter as insert 211. Insulator 217 is press-fit or lightly glued to the rear of insulator 211. Insulator 217 is followed by a comparatively long conductive armature section 219. The conducting armature section 219 is followed by an arc resistant section 221 and snubber section 223. Sections 217, 219, 221 and 223 comprise the bullet which is to be shot toward the chosen target. Operation of the projectile depicted in FIGS. 5 and 6 is analogous to the operation of the projectile depicted in FIG. 2. Specifically, a pair of rails similar to rails 41 and 43 depicted in FIG. 1 is utilized. However, as mentioned before, surfaces 69 and 71 of rail 43 must be contoured to closely fit conical conductive portions 203 and 205 of header 201. Otherwise, launching of projectile 200 is in all other respects similar to the sequence already described in connection with FIGS. 4, 10 and 11. Projectile 200 is launched through a hole similar to that designated by reference numeral 63 in FIG. 1. Ultimately, header sections 203 and 205 contact a gap similar to that designated by reference numeral 67 in FIG. 1. Header sections 203 and 205 are restrained by closely mating surfaces similar to those designated by reference numerals 69 and 71. Momentum of the projectile causes insulator 217 to push forward through header 201, forcing insulator 211 forward. Eventually, insulator 211 drops away and conducting armature 219 makes contact with conductive header sections 203 and 205. Current immediately begins to flow through armature 219 and the rail contacting conductive sections 203 and 205. The bullet, consisting of sections 217, 219, 221 and 223 is then accelerated toward is chosen target. Arc resistant-section 221 and snubber 223 perform like their respective counterparts 121 and 123 in FIG. 4.

The embodiment illustrated in FIGS. 5 and 6 shows a conical header with a circular cross-section. However, conductive portions 203 and 205 may be contoured in a variety of ways. For example, conductive sections 203 and 205 may be contoured to present an elliptical cross-section. Of course, corresponding interfaces such as those designated by reference numeral 71 and 69 in FIG. 1 must be respectively contoured to receive the header and hold it securely. An advantage of an elliptically contoured header is that it would prevent the projectile from arriving in the gap in such a way that the rail short-circuited an insulator such as 213 in FIG. 5.

Figure 7:
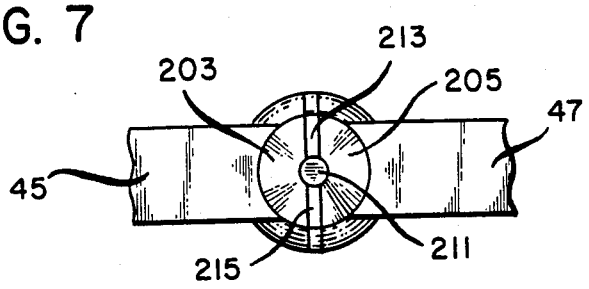
FIG. 7 and 8 are perspective views showing how the device of FIG. 5 may fit with a railgun.
Figure 8:
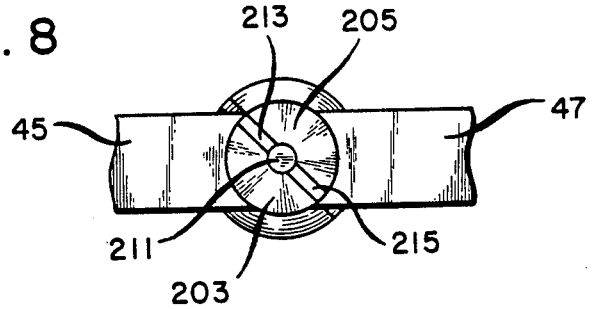
Figure 9:
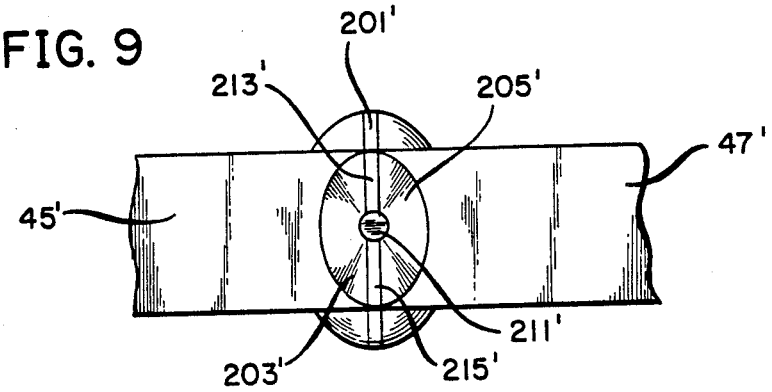
FIG. 9 is a perspective view of an alternative embodiment of the present invention.

The foregoing is more completely illuminated by FIGS. 7–9. FIGS. 7 and 8 show two possible orientations of projectile header 201 of FIG. 5 between rails 45 and 47. In the configuration depicted in FIG. 7, the bullet will be fired successfully (towards the viewer) because insulators 213, 211 and 215 prevent current flow from rail 45 to 47. However, examination of FIG. 8 shows that, should the projectile and healer be rotated before the header engages the rails, then rail 45 may contact both conductive sections 205 and 203, while rail 47 simultaneously contacts both conductive sections 205 and 203. The result, depicted in FIG. 8 is a short circuit which may interfere with launching of the projectile. However, FIG. 9 illustrates a projectile with a header 201' which has an elliptical cross-section. After header 201' engages rails 45' and 47', insulators 213', 215' and 211' serve to prevent current flow from rail 45' to 47'. Header 201' cannot be rotated in any manner analogous to that depicted in FIG. 8, and consequently, the short-circuiting depicted in FIG. 8 is prevented.

The wedge-shaped header depicted in FIGS. 2–4 is also designed to prevent misfire due to rotation of the projectile. As can be seen from FIG. 2 (and FIG. 3) the upper and lower surfaces 700 and 701 respectively of header 101 are parallel, whereas side surfaces 107 and 109, which form a wedge shape, are divergent. Consequently, the projectile header may be sized so that should the projectile accidentally be rotated, surfaces 700 and 701 will not contact surfaces 69 and 71 of rails 47 and 45 respectively. Thus, should an accidental rotation occur, the projectile will merely pass through the rails without jamming.

The illustrative embodiments herein are merely a few of those possible variations which will occur to those skilled in the art while using the inventive principles contained herein. Accordingly, numerous variations of the invention are possible all staying within the spirit and scope of the invention as defined in the following claims and their legal equivalents.

What is claimed is:

1. A projectile for use in an electromagnetic railgun, said railgun being of the type wherein a bullet is launched in a direction perpendicular to two parallel conductive rails by the repulsive force created by oppositely-flowing currents through the two rails, the first rail of said two rails having a shaped gap or trench which prevents the flow of current in said first rail, said shaped gap being larger closer to the second of said two rails and smaller further from said second rail, said projectile comprising a header section having two conductive portions with sloping sides, said conductive portions being separated by two insulating portions, said conductive portions and said insulating portions serving to define a hole through said header section, said sloping sides mating closely with said shaped gap in the first rail of said two parallel conductive rails; and a bullet section having an insulating nose protruding into said hole, a conductive body attached behind said nose and an insulating snubber behind said body; said entire bullet section being sized to pass through said hole in a direction perpendicular to said parallel conducting rails.

2. An electromagnetic railgun for launching a projectile having a header section and a bullet section, said railgun comprising first and second parallel conductive rails spaced approximately opposite each other;

conduction means electrically connecting said first and second parallel conductive rails at one end thereof, said conduction means, said first rail, and said second rail being fixed relative to one another;

first and second terminals electrically connected to said first and second rails, respectively, at the other end thereof, such that a continuous path drawn from said first terminal through said first rail, thence through said conduction means, thence through said second rail, thence to said second terminal travels in opposite directions through said first and second rails;

said first rail having a shaped gap which prevents the flow of electrical current in said first rail, said shaped gap being larger closer to said second rail and smaller further from said second rail, said shaped gap closely mating with said header section of said projectile, said shaped gap sized to permit the passage of said bullet therethrough; and means of applying a voltage across said first and second terminals such that, when said bullet enters said shaped gap, electrical current flows through said rails, said conduction means, and said bullet, said electrical current thus accelerating said bullet away from said rails in a direction perpendicular to said rails.

3. A projectile for use in an electromagnetic railgun that includes a pair of coextensive parallel conductive rails electrically interconnected at one end thereof, a substantially V-shaped gap or trench in one of said rails serving to sever said rail into two sections, the gap opening being larger nearer the other rail, said projectile comprising a trapezoidal header section having two trapezoidal sides, parallel to and opposite to each other, the edges of said trapezoidal sides being configured to mate closely with the shaped gap when said projectile is properly oriented, said trapezoidal sides being separated a distance which is no greater than the smallest dimension of said gap such that a misoriented projectile thrust into said gap may pas through said gap without triggering said railgun;

said header section having two conductive portions and a thin insulating section therebetween, said insulating section being essentially perpendicular to one said trapezoidal side and being essentially perpendicular to the base of one said trapezoidal side, said header section also having a hole extending therethrough, parallel to one of said trapezoidal sides and severing said insulating section; and a cylindrical bullet section having an insulating nose disposed in the hole in the header section, an extended conductive body behind said nose and an insulating snubber section behind said conductive body; said bullet section being of a size to permit passage through said hole and said gap in a direction perpendicular to the parallel conductive rails.

4. An electromagnetic railgun for the discharge of a bullet section of a projectile having a trapezoidal header section, said railgun comprising a pair of coextensive parallel conductive rails spaced a predetermined distance apart, means for electrically connecting the rails at one end thereof, a substantially V-shaped gap or trench in one of said rails serving to sever the same into two sections, the gap opening being larger nearer the other rail, an entryway in said other rail directly opposite said gap, said entryway being slightly larger in size than the projectile to allow said projectile to be loaded in said railgun by passing through said entryway without making contact therewith, said V-shaped gap being dimensioned to mate with said trapezoidal header with its smallest gap distance larger than the size of said bullet so the latter can pass therethrough.

5. An electromagnetic railgun as defined in claim 4 wherein an insulator surrounds said entryway to prevent any conductive contact between the projectile and the conductive rail.

6. A projectile for use in an electromagnetic railgun, said railgun being of the type wherein a bullet is launched in a direction perpendicular to two parallel conductive rails by the repulsive force generated by oppositely-flowing currents through the two rails, the first rail of said two rails having a wedge shaped gap or trench which prevents the flow of current in said first rail, said wedge shaped gap being larger closer to the second of said two rails and smaller further from said second rail, said projectile comprising:

a wedge shaped header section having two conductive portions with sloping sides, said conductive portions being separated by two insulating portions, said conductive portions and said insulating portions serving to define a hole through said header section, said sloping sides mating closely with said wedge shaped gap in the first rail of said two parallel conductive rails; and a bullet section having an insulating nose protruding into said hole, a conductive body attached behind said nose and an insulating snubber behind said body, the entire said bullet section being sized to slide through said hole in a direction perpendicular to said parallel conducting rails;

said bullet section being projected b said railgun when said conductive body slides through said header section and spans said conductive portions of said header section, thus permitting electrical current to flow through said rails, through said header section, and through said bullet section.

7. The projectile defined in claim 6 further comprising an arc resistant section between said conductive body and said snubber section.

8. In combination, an electromagnetic railgun and projectile therefor, said railgun comprising;

a pair of coextensive parallel conductive rails spaced a predetermined distance apart, means for electrically connecting the rails at one end thereof, a substantially V-shaped gap or trench in one of said rails serving to sever the same into two sections, said gap opening being larger nearer the other rail, an entryway in said other rail directly opposite said gap, said entryway being slightly larger in size than said projectile to permit said projectile to pass through said entryway without making contact therewith; and said projectile comprising a wedge shaped header section having two conductive portions with sloping sides, said conductive portions being separated by two insulator, said conductive portions and said insulators serving to define a hole through said header section, said sloping sides mating closely with said wedge shaped gap or trench in the first rail of said two parallel conductive rails; and a bullet section having an insulating nose protruding into said hole, a conductive body attached behind said nose and an insulating snubber behind said body, the entire said bullet section being sized to slide through said hole in a direction perpendicular to said parallel conductive rails;

said bullet section being projected by said railgun when said conductive body slides through said header section and spans said conductive portions of said header section, thus permitting electrical current to flow through said rails, through said header section, and through said bullet section; and said gap in said conductive rail being dimensioned to mate with said trapezoidal header with its smallest gap distance larger than the size of said bullet so the latter can pass therethrough.

9. The combination as defined in claim 8 wherein an arc resistant section is interposed between said conductive body and said snubber section of said bullet section of said projectile.

* * * * *